US006642456B2

(12) United States Patent
Valadez et al.

(10) Patent No.: US 6,642,456 B2
(45) Date of Patent: Nov. 4, 2003

(54) FLEXIBLE AUTOMOTIVE ELECTRICAL CONDUCTOR OF HIGH MECHANICAL STRENGTH USING A CENTRAL WIRE OF COPPER CLAD STEEL AND THE PROCESS FOR MANUFACTURE THEREOF

(75) Inventors: Armando Rodriguez Valadez, Querétaro Qro. (MX); Belisario Sanchez Vazquez, Queretaro Qro. (MX)

(73) Assignee: Servicios Condumex, Queretaro (MX)

( * ) Notice: Subject to any disclaimer, the term of this patent is extended or adjusted under 35 U.S.C. 154(b) by 0 days.

(21) Appl. No.: 09/739,596

(22) Filed: Dec. 19, 2000

(65) Prior Publication Data

US 2001/0000590 A1 May 3, 2001

Related U.S. Application Data

(63) Continuation-in-part of application No. 09/168,902, filed on Oct. 9, 1998.

(51) Int. Cl.[7] ..... H01B 5/00; H01B 5/08

(52) U.S. Cl. ..... 174/126.1; 174/128.1

(58) Field of Search ..... 174/128.1, 126.1, 174/126.2, 127, 128.2

(56) References Cited

U.S. PATENT DOCUMENTS

| | | | | |
|---|---|---|---|---|
| 251,114 | A | * 12/1881 | Hallidie | |
| 1,629,168 | A | * 5/1927 | Massingham | |
| 3,131,469 | A | * 5/1964 | Glaze | 29/470.5 |
| 3,831,370 | A | * 8/1974 | Gilmore | 57/145 |
| 4,492,602 | A | * 1/1985 | Lee et al. | 148/11.5 C |
| 5,133,121 | A | * 7/1992 | Birbeck et al. | 29/872 |
| 5,170,015 | A | * 12/1992 | Kudo et al. | 174/128.1 |
| 6,303,868 | B1 | * 10/2001 | Kawai | 174/128.1 |
| 6,331,676 | B1 | * 12/2001 | Gutierrez et al. | 174/128.1 |
| 6,362,431 | B1 | * 3/2002 | Gutierrez et al. | 174/128.1 |

FOREIGN PATENT DOCUMENTS

| | | | |
|---|---|---|---|
| EP | 0 331 182 | * 9/1989 | H01B/5/08 |

* cited by examiner

*Primary Examiner*—William H. Mayo, III
(74) *Attorney, Agent, or Firm*—Jonathan E. Grant; Grant Patent Services

(57) ABSTRACT

The invention relates to the manufacturing of a seven wire symmetrical hybrid conductor containing a hard copper alloy wire of copper clad steel in the center and six hard ETP copper peripheral wires in 24 and 26 AWG in sizes that fulfills the SAB J 1678 Ford specificiation with regard to electrical resistance and breaking load, having an outside diameter forming a tubular wall with very light undulations.

22 Claims, 2 Drawing Sheets

FLEXIBLE AUTOMOTIVE ELECTRICAL CONDUCTOR OF HIGH MECHANICAL STRENGTH USING A CENTRAL WIRE OF COPPER CLAD STEEL AND THE PROCESS FOR MANUFACTURE THEREOF

This application is a continuation-in-part application of U.S. patent application Ser. No. 09/168,902 filed on Oct. 9, 1998 which claims the benefit of the priority of Mexican Patent Application Ser. No. 983858 filed on May 15, 1998.

BACKGROUND OF THE INVENTION

1. Field of the Invention

The present invention is for an improved low tension primary cable for automotive use.

2. Description of the Related Art

Among the technological developments regarding the automotive industry, there are processes focused towards the manufacturing of low tension primary cable for automotive vehicle use.

The requirements of the automotive industry, world-wide, for materials to be used in the short term (year 2000), are based on the following aspects:

- trends in the automotive market at world level;
- alternatives to fulfill the requirements of the automotive industry;
- present and future norm and specifications of the automotive industry; and
- commercially available materials that, according to their properties, can fulfill the automotive cable requirements.

The trends in the automotive industry have been focused towards weight reduction in order to reach a lower demand for fuel. On the other hand, the demand for vehicles that offer better safety, luxury and comfort, and the consequent need for cables for the various additional circuits, have increased rapidly and will continue to increase in the coming years.

Conductor diameter reduction, while maintaining the same mechanical characteristics as the conductors presently used in the automotive harnesses, is the alternative chosen by the designers and it will continue to be the main trend during the coming years. This makes it necessary to resort to conductor materials more mechanically resistant than copper, keeping an adequate balance between mechanical resistance and electrical conductivity in order to meet the specifications.

Presently there are two specification proposals with regard to an automotive cable that covers the previously described characteristics, the proposals being as follows:

- Norm SAE J-1678 "Low Tension, Ultra Thin Wall Primary Cable"
- FORD Engineering Specification—"Cable, Primary Low Tension 0.25 mm and 0.15 mm Wall".

The prior art does not describe the material with which conductors have to be manufactured, but establish a minimum breaking load as well as a maximum electrical resistance; in this case, the present invention encompasses the 24 and 26 AWG conductors, which present as design condition a seven-wire strand symmetrical formation.

BRIEF DESCRIPTION OF THE INVENTION

Presently, the conductor used for gauges below 22 AWG are manufactured from 100% copper alloy which must have a mechanical and electrical resistance that meets the above specification.

It is thus an object of the present invention to produce:

A flexible automotive electrical conductor of high mechanical strength, with a seven-wire strand symmetrical construction, i.e., to use a high strength wire of copper clad steel in the center and 6 hard electrolytic tough pitch (ETP) copper wires in the periphery. With regard to 24 AWG gauge conductor, the 7 wires are 32 AWG gauge; with regard to the 26 AWG gauge conductor, the center wire is 33 AWG gauge, while the 6 peripheral wires are 34 AWG gauge.

BRIEF DESCRIPTION OF THE DRAWINGS

The invention will be better understood and its objects and advantages will become more apparent by reference to the following drawing, in which.

DETAILED DESCRIPTION OF THE INVENTION

The present invention is a hybrid conductor, i.e., the high strength central wire of copper clad steel must have a mechanical resistance higher than the mechanical resistance of hard condition electrolytic copper, while the peripheral wires must be made of electrolytic copper in hard condition.

The cable is constituted by a central wire of copper clad steel (CCS) in hardened condition (2% elongation or less) and 6 peripheral wires of electrolytic tough pitch (ETP) copper in hardened condition, stranded around the central CCS wire.

Figure 1:
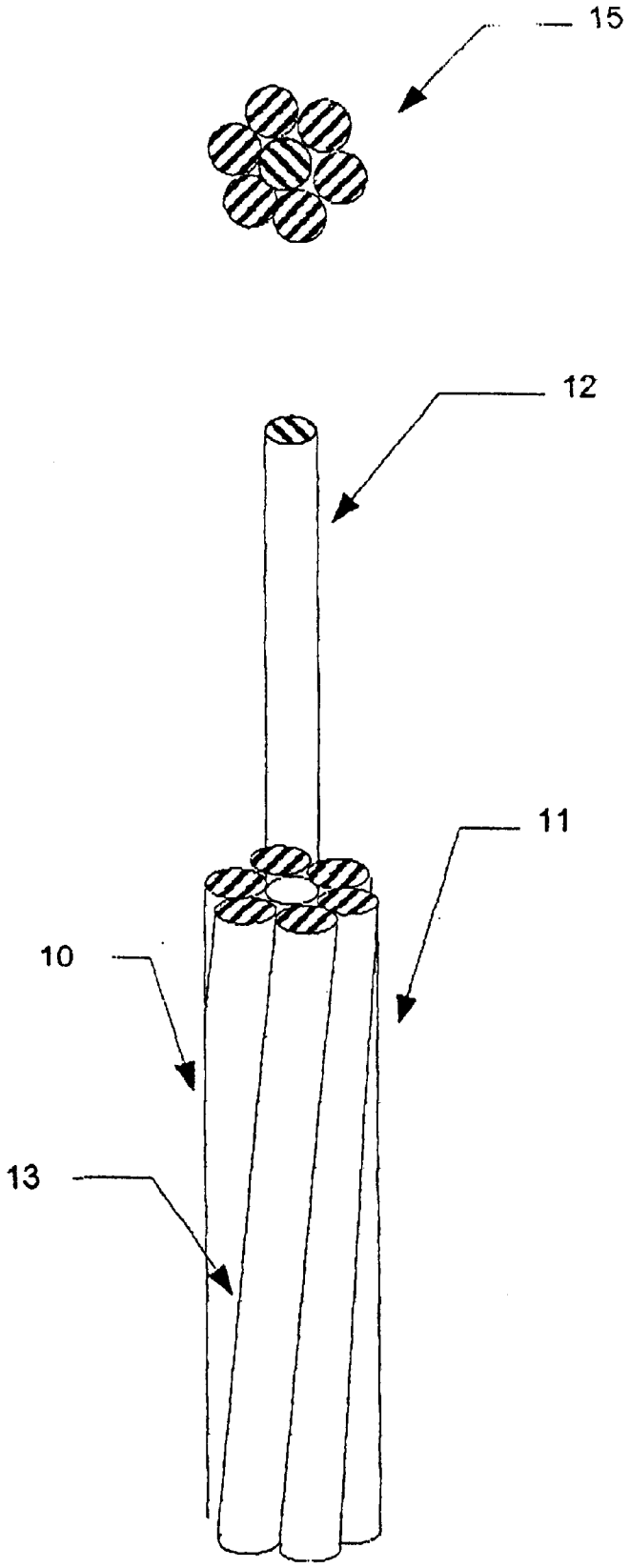
FIG. 1 is a cross sectional view and a longitudinal view of the 24 AWG gauge conductor
Figure 2:
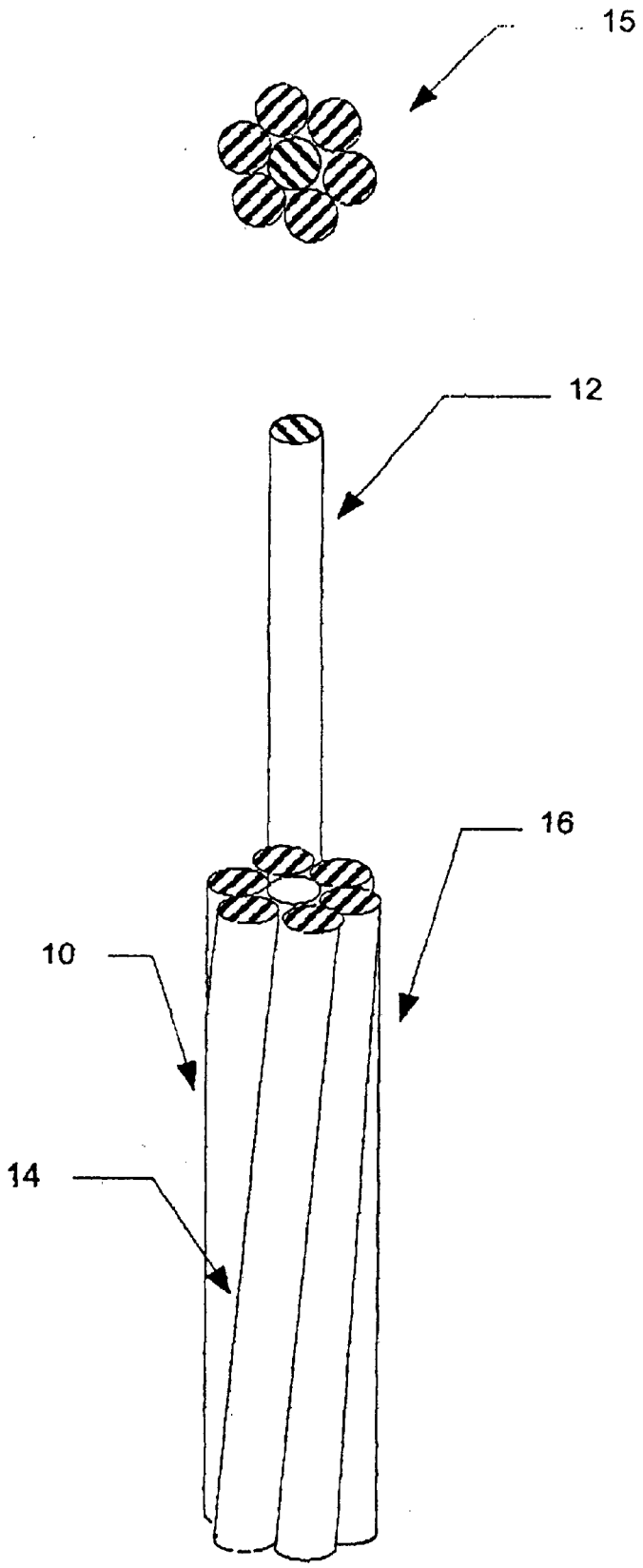
FIG. 2 is a cross-sectional view and a longitudinal view of a conductor with 26 AWG gauge.

The automotive electric conductor 10 is a symmetrical hybrid conductor 15 made up of a bundle of seven wires 11 and 16 respectively in FIG. 1 and in FIG. 2. In the case of 24 AWG gauge conductor, the seven wires are 32 AWG gauge, while in the case of 26 AWG gauge conductor, the central wire 12 is 33 AWG gauge, and the peripheral wires 16 are 34 AWG gauge. For both conductors, the central wire 12 is made of copper alloy (copper clad steel) in hard condition and must have a mechanical resistance of above 90 kg/mm$^2$ with a minimum elongation of 2% or less, while the peripheral wires in both conductors are made of hard ETP copper and must have a mechanical resistance of above 50 kg/mm$^2$ with a minimum elongation of 1%.

The high strength materials are copper clad steel with 40% conductivity C23000 brass and C27000 brass.

The lay is the straight length at which the same wire of the conductor appears at a similar point after having helically traveled along the conductor. This variable must be such that the central wire is always located at the center of the conductor. Thus, a 24 AWG gauge conductor must have a lay 13 shorter than 15 mm and a 26 AWG gauge conductor must have a lay 14 shorter than 10 mm.

The following Table I shows the characteristic features of the conductor such as physical, mechanical and electrical characteristics which must be fulfilled, by each one of the conductors:

TABLE I

| CONDUCTOR AREA ($mm^2$) ISO | CONDUCTOR GAUGE (AWG) | CONDUCTOR DIAMETER (mm) Specified | MAXIMUM RESISTANCE (mΩ/m) Specified | MAXIMUM LOAD (Kg) Specified |
|---|---|---|---|---|
| 0.22 | 24 | 0.70 | 84.9/96.94 | 9 |
| 0.13 | 26 | 0.50 | 136/189 | 9 |

Hereinbelow, the manufacturing process is described for said flexible type electric conductor with high mechanical resistance based on high strength materials with some copper content, which is useful for automotive service.

The process includes the following stages: Breakdown drawing; final drawing (copper and high strength materials), thereafter the bunching, or stranding of high strength 24 AWG gauge conductor with 32 AWG gauge wire, or 26 AWG gauge conductor with 33 AWG gauge at the center and 6 wires 34 AWG gauge at the peripheral.

Hereinafter the above mentioned stages are described,

ETP Copper Breakdown Drawing

The starting material is 8 mm diameter annealed ETP copper wire, which is drawn in order to obtain an annealed 13 AWG gauge wire.

ETP Copper Final-drawing

It is obtained starting from an annealed 13 AWG gauge wire which is drawn in one unique step in unifilar (single wire) or multiline machine to obtain a 32 AWG gauge wire in the case of 24 AWG gauge conductor and 34 AWG gauge wire in the case of 26 AWG gauge conductor, both wires are in hard condition.

High Strength Material Final Drawing

The materials can be purchased in the form of annealed 20 AWG gauge wire and can be drawn in only one step in order to obtain 32 AWG gauge wire, in the case of 24 AWG gauge conductor, and 33 AWG gauge wire in the case of 26 AWG gauge conductor, both in hard condition.

Bunching of 24 AWG Gauge Conductor

In this stage, a bunching, or stranding machine is used in which a symmetrical construction of 7 wires is carried out. The central wire is high strength 32 AWG gauge wire and the 6 peripheral wires are made of 32 AWG gauge hard ETP copper wire. The lay of the conductor must be below 15 mm in order to insure the centering of the copper alloy wire.

Bunching of 26 AWG Gauge Conductor

At this stage, a bunching, or stranding machine is used in which a symmetrical construction of 7 wires is carried out. The central wire is high strength 33 AWG gauge wire and the 6 peripheral wires are made of 34 AWG gauge hard ETP copper wire. The lay of the conductor must be below 10 mm in order to insure the centering of the copper alloy wire.

The advantages offered by the hybrid conductor are:

Currently in automotive industry thinnest conductors used are 22 AWG gauge, and they are a strand of 7 ETP copper wires in annealed condition, satisfying a minimum strength of 58.8 N (Newtons) and maximum electric resistance of 65 mOhm/m at 20° C.

Proposed conductors are even thinner 24–26 AWG, with a higher mechanical strength than current conductors, satisfying a minimum strength of 88.3 N and maximum electric resistance of 97 mOhm/m for 24 AWG, and 189 mOhm/m for 26 AWG.

Finally this is a symmetric conductor that guarantees no problems using ultrathin insulation thing that does not happen when conductors are not symmetric.

It is a conductor with hard high strength wire (of copper clad steel) at the center and hard ETP copper at the periphery and it is not made of 100% copper alloy.

It is a conductor which is smaller and lighter than the present conductors but with a higher breaking load, as well as electrical resistance within the automotive specifications for copper alloys.

Upon bunching, or stranding it, this cable must be manufactured taking care that the tension is controlled in such a way that the wire is always in the center of the conductor in order to fulfill the maximum electric resistance requirements specified and to insure an excellent surface smoothness and concentricity.

In Table I, the physical mechanical and electrical properties that must be fulfilled by each one of the conductors are presented.

In the Table II, the chemical composition of the wires used in the manufacturing of hybrid conductors is described.

TABLE II

| MATERIAL | Cu (%) | Zn (%) | O (%) | Other (%) |
|---|---|---|---|---|
| ETP Cu | 99.9 | | 0.04 | 0.01 |
| C2300 brass | 85 | 15 | | |
| C2700 brass | 70 | 30 | | |

The copper clad steel wire is built by a core of low carbon steel with a carbon content of between about 0.08% to about 0.35%. This material represents the 65% of the cross area of the wire. This is coated by Electrolytic Tough Pitch (ETP) Annealed Resistant Copper Alloy C11100. This material reports a chemical analysis of 99.90% Copper and represents the rest of the cross area of 35%.

It is thus believed that the operation and construction of the present invention will be apparent from the foregoing description. The full scope of the present invention is defined by the following claims.

We claim:

1. A high mechanical strength, flexible automotive electrical conductor comprising:

a) a central wire comprising a high strength material in hard condition, said central wire being a copper clad steel having a carbon content of 0.08% to 0.35%, said copper clad steel comprising a steel wire cover with copper having 40% conductivity; and b) a plurality of wires consisting essentially of electrolytic tough pitch copper in hardened condition helically laid about the central wire.

2. The high mechanical strength, flexible automotive electrical conductor according to claim 1, wherein the central wire has a mechanical resistance of above 90 Kg/mm and a minimum elongation of less than 2%.

3. The high mechanical strength, flexible automotive electrical conductor according to claim 1, wherein the carbon content represents 65% of the cross area of the wire.

4. The high mechanical strength, flexible automotive electrical conductor according to claim 1, wherein the carbon steel is coated by the Electrolytic Tough Pitch (ETP) Anneal Resistant Copper Alloy C11100 which comprises 99.90% copper and represents 35% of the cross area of the wire.

5. The high mechanical strength, flexible automotive electrical conductor according to claim 1, wherein the central wire is a strength 32 AWG gauge wire.

6. The high mechanical strength, flexible automotive electrical conductor according to claim 5, wherein the wires helically laid about the central wire comprise six wires and are made of 32 AWG gauge hard ETP copper wire to form a 24 AWG gauge wire.

7. The high mechanical strength, flexible automotive electrical conductor according to claim 1, wherein the central wire is a high strength 33AWG gauge wire.

8. The high mechanical strength, flexible automotive electrical conductor according to claim 7, wherein the wires helically laid about the central wire comprise six wires and are made of 34 AWG gauge hard ETP copper wire to form a 26 AWG gauge wire.

9. The high mechanical strength, flexible automotive electrical conductor according to claim 8, wherein the lay of the wires is shorter than 15 mm.

10. The high mechanical strength, flexible automotive electrical conductor according to claim 9, wherein the lay of the wires is shorter than 10 mm.

11. A process for the manufacture of high mechanical strength, flexible automotive electrical conductor, comprising the steps of:

(a) performing a breakdown drawing of a central wire comprising a high strength material in hard conduction to obtain an annealed material, said high strength material of said central wire being a copper clad steel having a carbon content of 0.08% to 0.35%, said copper clad steel comprising a steel wire cover with copper having 40% conductivity;

(b) performing a final drawing of the annealed material; and (c) bunching the central wire with a plurality of wires to from said conductor, said plurality of wires consisting essentially of electrolytic tough pitch copper in hardened condition, said plurality of wires being helically laid around said central wire.

12. The process according to claim 11, wherein the central wire has a mechanical resistance of above 90 $Kg/mm^2$ and a minimum elongation of 2% or less.

13. The process according to claim 12, wherein the central wire is selected from the group consisting of a high strength 32 AWG gauge wire and a high strength 33 AWG gauge wire.

14. The process according to claim 13, wherein the wires helically laid about the central wire comprise six wires and are made of 32 AWG gauge hard ETP copper wire to form a 24 AWG gauge wire when the central wire is a 32 AWG gauge wire.

15. The process according to claim 13, wherein the wires helically laid about the central wire comprise six wires and are made of 34 AWG gauge hard ETP copper wire to form a 26 AWG gauge wire when the central wire is a 33 AWG gauge wire.

16. The process according to claim 11, wherein the six peripheral wires helically laid about the wire are made of hard electrolytic tough pitch copper C11100 alloys ETP copper having a mechanical resistance of above 50 $Kgmm^2$ and a 1% minimum elongation.

17. A high mechanical strength, flexible automotive electrical conductor comprising:

a) a central wire comprising a high strength material in hard condition having a mechanical resistance of above 90 $Kg/mm^2$ and a minimum elongation of no more than 2%, said central wire being selected from the group consisting of32 AWG gauge wire and 33 AWG gauge wire, said central wire being a copper a clad steel having a carbon content of 0.08% to 0.35%, said copper clad steel comprising a steel wire cover wire cover with copper having 40% conductivity; and b) a plurality of wires consisting essentially of electrolytic tough pitch copper in hardened condition helically laid about the central wire, said plurality of wires having a mechanical resistance of above 50 $Kgmm^2$ and a 1% minimum elongation.

18. The high mechanical strength, flexible automotive electrical conductor according to claim 17, wherein the central wire is a high strength 32 AWG gauge central wire, and said wires helically laid about the central wire comprise six wires made of 32 AWG gauge hard ETP copper wire to form a 24 AWG gauge wire.

19. The high mechanical strength, flexible automotive electrical conductor according to claim 18, wherein the lay of the wirers is shorter than 15 mm.

20. The high mechanical strength, flexible automotive electrical conductor according to claim 17, wherein the carbon content represents 65% of the cross area of the wire.

21. The high mechanical strength, flexible automotive electrical conductor according to claim 20, wherein the lay of the wires is shorter than 10 mm.

22. The high mechanical strength, flexible automotive electrical conductor according to claim 17, wherein the carbon steel is coated by the Electrolytic Tough Pitch (ETP) Anneal Resistant Copper Alloy C11100 which comprises 99.90% copper and represents 35% of the cross area of the wire.

* * * * *